US005808416A

United States Patent [19]

Armini

[11] Patent Number: 5,808,416

[45] **Date of Patent: *Sep. 15, 1998**

[54] ION SOURCE GENERATOR AUXILIARY DEVICE

[75] Inventor: Anthony J. Armini, Manchester, Mass.

[73] Assignee: Implant Sciences Corp., Wakefield, Mass.

[ * ] Notice: The term of this patent shall not extend beyond the expiration date of Pat. No. 5,309,064.

[21] Appl. No.: 742,896

[22] Filed: Nov. 1, 1996

[51] Int. Cl.[6] ..... H01J 7/24

[52] U.S. Cl. ..... 315/111.81; 315/111.21; 315/111.71; 250/423 R

[58] Field of Search ..... 315/111.81, 111.21, 315/111.71, 111.31, 111.41; 250/423 R, 296

[56] References Cited

U.S. PATENT DOCUMENTS

| | | | |
|---|---|---|---|
| 3,689,766 | 9/1972 | Freeman | 250/49.5 T |
| 3,774,026 | 11/1973 | Chavet | 250/41.9 ME |
| 4,533,831 | 8/1985 | Itoh et al. | 250/492.2 |
| 5,089,746 | 2/1992 | Rosenblum et al. | 315/111.81 |
| 5,189,303 | 2/1993 | Tanjyo et al. | 315/111.81 X |
| 5,309,064 | 5/1994 | Armini . | |
| 5,517,084 | 5/1996 | Leung | 315/111.81 |

*Primary Examiner*—Robert J. Pascal
*Assistant Examiner*—Haissa Philogene
*Attorney, Agent, or Firm*—Don Halgren

[57] ABSTRACT

An ion source generating device having a main arc chamber and an auxiliary chamber attached to and in fluid communication with the main chamber. The auxiliary chamber contains solid reactants consisting of $Ca_3P_2$ or $Mg_3As_2$ to provide a reduction reaction of feed gas such as HF or $H_2O$ respectively, passing through the chamber and into the main chamber, in which the ion beam is generated.

9 Claims, 2 Drawing Sheets

ION SOURCE GENERATOR AUXILIARY DEVICE

BACKGROUND OF THE INVENTION

1. Field of the Invention

The present invention relates to ion sources utilized in ion beam generating equipment. More particularly, this invention relates to an arrangement for minimizing hazards from feed gases in ion source generators, and is an improvement over my earlier U.S. Pat. No. 5,309,064, incorporated herein by reference, in its entirety.

2. Prior Art

Ion sources in the semi-conductor industry are utilized to generate intense ion beams of phosphorous and arsenic, for doping silicon microcircuits.

U.S. Pat. No. 3,689,766 to Freeman shows an ion beam source utilized for implantation on an industrial production scale including means for automatically moving targets through the ion beam.

U.S. Pat. No. 3,774,026 to Chavet discloses an ion optical system for use with a magnetic prism so that its ion beam can converge in the vertical plane for effective focusing thereof.

An ion source generally consists of a plasma chamber from which a beam of positive ions can initially be extracted, and from which it then may be accelerated. The actual physics and technology of ion sources may be uncovered in D. Aiken, "Ion Sources", Chapter 2, Ion Implantation Techniques, H. Ryssel and H. Glaswischnig, eds., Springer-Verlag, Berlin (1982), which is hereby incorporated by reference.

The structure of a typical ion source such as the known "Freeman" type, consists of a cylindically shaped arc chamber which contains a tungsten filament, heatable by electric current, so as to thermionically emit electrons.

A gas may be introduced into the arc chamber at a pressure of about $10^{-3}$ Torr, which forms a plasma discharge between the arc chamber and the filament, which is biased at about minus 100 V. Positive ions from this plasma discharge are then electrostatically extracted from the plasma and are accelerated through an aperture in the extraction electrode wall.

In generating phosphorous and arsenic ion beams, phosphine ($PH_3$) and arsine ($AsH_3$), which are bottled gas feeds, are typically used because they yield the best control and give large currents of pure $^{31}P+$ and $^{75}As+$ beams, respectively.

Arsine and phosphine gases, however, are two of the most toxic and dangerous gases known. Arsine is particularly dangerous because it is invisible in air and is already above lethal concentrations before humans can detect its odor. Phosphine is only slightly less toxic.

Alternately, some ion sources use solid elemental phosphorous and arsenic which is vaporized in-situ in a heated chamber prior to introduction into the ion source. While this feed material yields large beam currents, the technique suffers from long heating times and many toxic cleanup and disposal problems.

Other gases have been used, i.e. the pentafluorides, $PF_5$ and $AsF_5$, which are convenient bottled gases, less toxic than arsine or phosphine, but they suffer poor $^{31}P+$ and $^{75}As+$ ion beam currents, and, for this reason, they are seldom used in a production environment.

My U.S. Pat. No. 5,309,064 describes an ion source generator having an auxiliary chamber which contains chips of barium, calcium or cerium to provide a reduction reaction of feed gas passing through the chamber and into the main chamber where the ion beams are generated, minimizing many of the problems of the prior art.

It is yet however, the principal object of the present improved ion source invention to overcome other disadvantages of the prior art by providing alternative ion sources for $^{31}P+$ and $^{75}As+$ and other ions which do not use feed gases containing the toxic and dangerous $PF_5$ and $AsF_5$ gases, but instead uses these elements only in a solid compound form which is much less toxic and easier to handle.

BRIEF SUMMARY OF THE INVENTION

The present invention comprises an ion generating device having an arc chamber of the "Freeman" type which is in fluid communication with an adjacent auxiliary chamber. The arc chamber is generally cylindrically shaped, having walls made of for example: graphite, molybdenum or stainless steel.

The arc chamber has an upper and lower end. A discharge orifice is disposed in the wall of the arc chamber. The orifice is a longitudinally extending slot, having dimensions for example, of about 60 mm by about 2 mm. The arc chamber may also have one or more round orifices of about 2–4 mm. in diameter.

A tungsten filament is disposed between the upper and lower ends of the arc chamber, in alignment with and in proximity with the discharge orifice. The tungsten filament is insulatively disposed with respect to the upper and lower ends of the arc chamber.

The auxiliary chamber is attached to the side wall of the arc chamber, diametrically opposite the discharge orifice. The auxiliary chamber is of walled construction similar to the arc chamber, preferably of molybdenum or graphite.

An inlet gas line is in fluid communication with the distal end of the auxiliary chamber. The auxiliary chamber is adapted to contain a reactant compound of material such as $Ca_3P_2$ (calcium phosphide) or $Mg_3As_2$ (magnesium arsenide). The auxiliary chamber and the arc chamber are attached to one another and are themselves in fluid communication, through an interdisposed mesh screen therebetween.

The arc chamber is heated by a current through the tungsten filament. The arc chamber typically operates at a temperature in the range of about 1000° C. The auxiliary chamber, due to this disposition with respect to the arc chamber, is heated to about 500°–700° C. by the waste heat therefrom. Alternately the auxiliary chamber could have its own heat source.

A feed gas, such as for example, $H_2O$ or other oxygen or fluorine containing gases, is driven through the inlet gas line and into the auxiliary chamber, through the hot $Ca_3P_2$ or $Mg_3As_2$, and chemically reacts therewith. The feed gas is then reduced to either $PH_3$ or $AsH_3$ respectively, by the chemical reaction. The respective chemical reactions for the particular feed gases are:

$$Ca_3P_2 + 6HF \xrightarrow{500^\circ\ C.} 2PH_3 + 3CaF_2$$

or $$Mg_3As_2 + 3H_2O \xrightarrow{500^\circ\ C.} 2AsH_3 + 3MgO$$

The $CaF_2$ which is formed in the auxiliary chamber, is the very stable and inert mineral fluorite. The $PH_3$ and the $AsH_3$, which are gases at 500° C., are channeled into the arc chamber to form a pure elemental plasma with minimal contamination from $CaF_2$ or the MgO compounds. Although water may be chosen as the reactant gas in the phosphorous reaction case, there could be a small peak at mass 32 ($O_2$) in the spectrum which is too close to phosphorous at 31. Therefore HF was chosen to react with $Ca_3P_2$ instead of water which would otherwise be the better of the two gases to use as far as personal safety is concerned.

The present invention, with the feed gas not containing the desired target element such as for example, arsenic or phosphorous (As or P), is reduced by the hot $Ca_3P_2$ or $Mg_3As_2$ reactant compound in the auxiliary chamber causing the fluoride and oxide to precipitate out and remain in the auxiliary chamber as $CaF_2$ and MgO, permitting the arsenic As or phosphorous P to enter the arc chamber as a pure element.

The invention thus includes an ion source for producing an ion beam from a feed gas comprising an arc chamber having an inlet orifice and an outlet orifice, an auxiliary chamber in fluid communication with the arc chamber, a solid reactant disposed in the auxiliary chamber, the solid reactant comprising the element to be transformed to an ion beam, a feed gas input line into the auxiliary chamber arranged to direct a feed gas therein, for reaction with said solid reactant therein, a filament for generating electrons in said arc chamber, together with a power source for heating and biasing the filament, and the solid compound contained in the auxiliary chamber providing a reduction reaction of the feed gas passing therethrough. The solid reactant therefore may be an appropriate chemical element. The solid reactant may also be selected from the group consisting of metal phosphides or metal arsenides. A feed gas is driven through the solid reactant and may be selected from the group consisting of oxygen, fluorine or chlorine containing gases. The auxiliary chamber containing the solid compound may be heated by an external power source.

The auxiliary chamber containing the solid reactant is heated to a temperature of about 500° C. to about 700° C. The auxiliary chamber is preferably heated by contact with the heated arc chamber.

The invention includes a method of generating an ion beam from an arc chamber, comprising the steps of attaching an auxiliary chamber to a wall of the arc chamber, with an orifice providing fluid communication therebetween, introducing a solid reactant into the auxiliary chamber, heating the arc chamber up to within a temperature range of about 900° C. to about 1000° C. with an energizable electron emitting filament thereacross, passing a feed gas under pressure through the compound in the auxiliary chamber so as to form a stable solid fluoride, oxide or chloride compound therein, and emitting an ion beam from an exit orifice in the heated arc chamber. The method includes selecting the solid reactant from the group consisting of metal phosphides or metal arsenides. The method also includes selecting the feed gas to be passed through the auxiliary chamber from the group consisting of gases containing oxygen, fluorine or chlorine.

BRIEF DESCRIPTION OF THE DRAWINGS

The objects and advantages of the present invention will become more apparent when viewed in conjunction with the following drawings in which.

DESCRIPTION OF THE PREFERRED EMBODIMENTS

Figure 1:
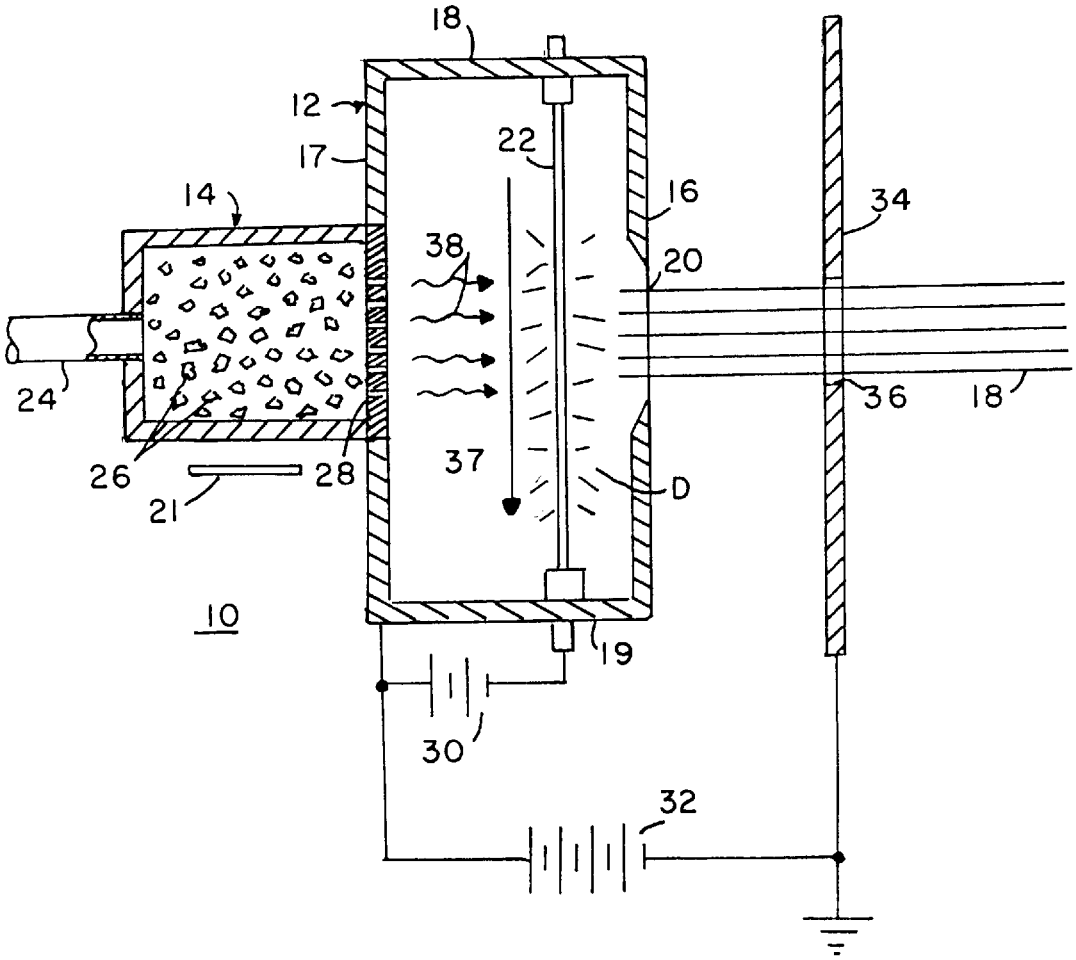
FIG. 1 is a cross-sectional view of an ion source generator constructed according to the principles of the present invention.

Referring now to the drawings in detail, and particularly to FIG. 1, there is shown an ion source 10 comprised of a generally cylindrically shaped arc chamber 12 in fluid communication with an auxiliary chamber 14. The arc chamber 12 has a front wall 16 and end walls 18 and 19, which chamber is preferably made of graphite or molybdenum.

A discharge orifice 20 is disposed through the front wall 16 of the arc chamber 12. The orifice 20 is a longitudinally extending slot, having a lengthwise dimension of about 30 to 60 mm, and a width of about 2 mm.

A tungsten filament 22 is insulatively disposed between the end walls 18 and 19, in longitudinal alignment with, and close proximity to the discharge orifice 20 in the front wall 16.

The auxiliary chamber 14 is attached to a rear wall 17 of the arc chamber 12, diametrically opposite the discharge orifice 20. The auxiliary chamber 14 has walls made of molybdenum or graphite, which are about 2 mm. thick, and has a volume of about 10 $cm^3$.

An inlet gas feed line 24 is in fluid communication with the distal end of the auxiliary chamber 14, as shown in FIG. 1. The inner volume of the auxiliary chamber 14 is arranged to hold about 20 to 50 grams of a reactant compound 26 such as $Ca_3P_2$ or $Mg_3As_2$.

It is noted that the reactant compound could be an element in lump form of about 1 mm. to about 10 mm. in width. The auxiliary chamber 14 and the arc chamber 12 are attached and are themselves in fluid communication through a grate 28 or mesh screen in the rear wall 17, which prevents slippage of reactant compound 26 therepast.

The arc chamber 12 is heated to a temperature of about 900°–1000° C. by current flow through the tungsten filament 22 therein. The tungsten filament 22 is powered by a direct current source 30, typically about 3 to 5 volts DC. at a current of 50 to 200 Amp. The auxiliary chamber 14 is heated to about 500°–700° C. by the waste heat from the arc chamber 12, or by an external auxiliary heater 21.

A feed gas such as hydrogen fluoride (HF) or water ($H_2O$) passes from the feed line 24 into the auxiliary chamber 14 and arc chamber 12 at a pressure of about $10^{-3}$ Torr. The feed gases have their respective chemical reactions as follows:

$$Ca_3P_2 + 6HF \xrightarrow{500^\circ\ C.} 2PH_3 + 3CaF_2$$

or $$Mg_3As_2 + 3H_2O \xrightarrow{500^\circ\ C.} 2AsH_3 + 3MgO$$

The $CaF_2$ and MgO which is formed during the respective reactions, are the very stable inert mineral fluorite and magnesium oxide respectively. The $PH_3$ and $AsH_3$ respectively, which are gases, enter the arc chamber 12, through the mesh 28, as shown in FIG. 1.

The ion source 10 is operated by first forming a plasma in the arc chamber 12. The plasma is formed when all four constituents are present, that is, the elemental gas 38, electron emission "D" from the hot filament 22, an arc voltage 30, between the filament 22 and the arc chamber 12, and a magnetic field 37, of for example about 100 gauss, arranged parallel to the filament 22. Once a stable plasma of arsenic (As) or phosphorous (P) positive ions is formed, it is extruded though orifice 20 and accelerated through orifice 36 by an extraction electrode 34. This extraction voltage is provided by a direct current voltage source 32 which is typically for example, about 20,000 to 40,000 volts. The ion beam (IB) thus generated may then be utilized in any commercial ion implanter such as Eaton NV-3206 or a Varian 350D.

Figure 2:
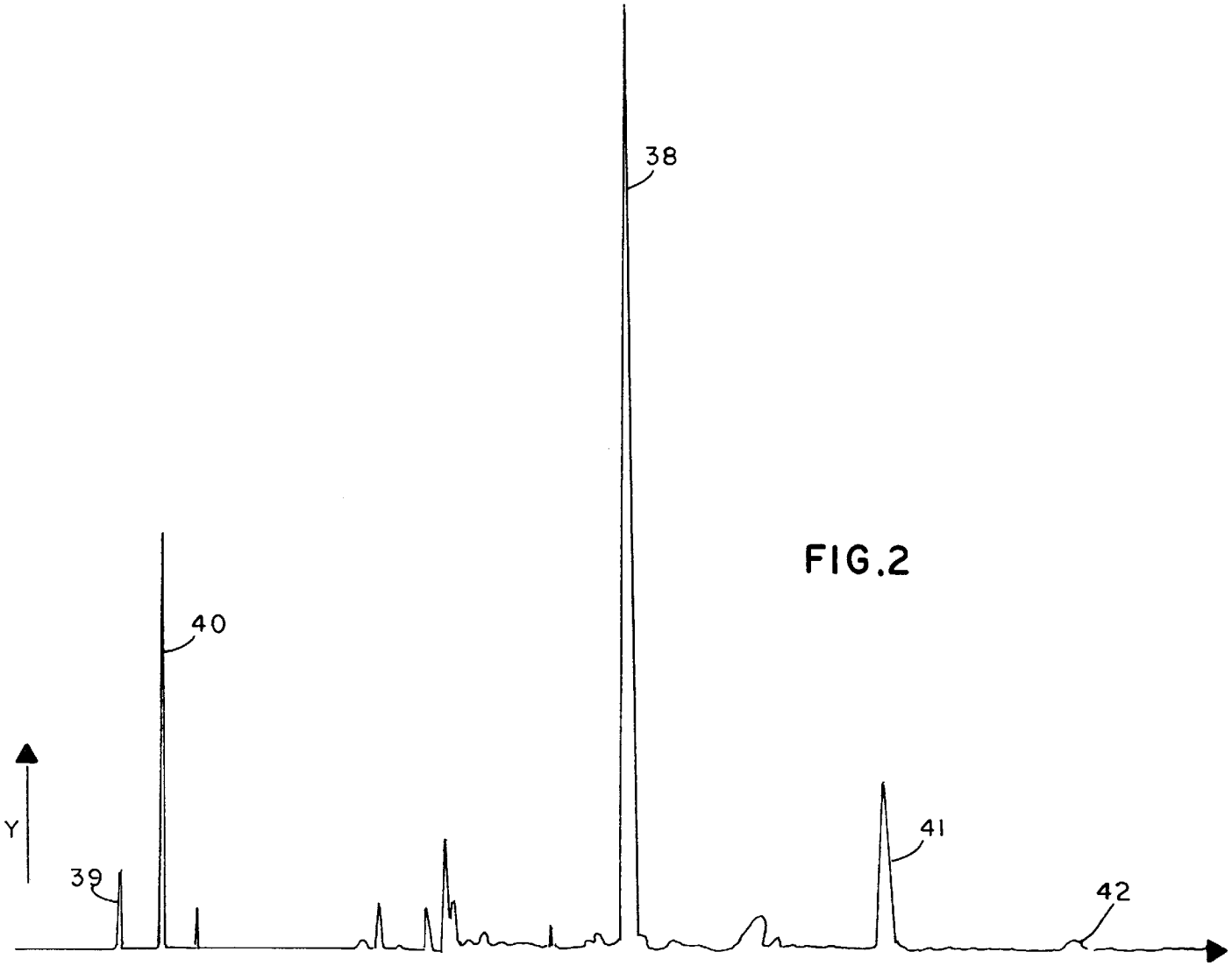
FIG. 2 is shows a phosphorus "mass spectrum" obtained from a semiconductor ion implanter, such as an Eaton Corporation model NV 3206 using HF as the feed gas with $Ca_3P_2$ in the auxiliary chamber, the plasma in the arc chamber and subsequently in the ion beam chamber emitted containing a large peak (38) of the $P^{31}$ ion as well as smaller peaks consisting of $H^1$(39), $H^2$(40), and $PF^{50}$(41) and $PF^{69}{}_2$ (42).

FIG. 2 shows a "mass spectrum" obtained from a semiconductor ion implanter, such as a Eaton Corporation model NV3206, using HF as a feed gas and with $Ca_3P_2$ in the auxiliary chamber. The plasma and subsequently the ion beam spectrum emitted contains a large peak (38) of the $P^{3l}$ as well as smaller peaks consisting of $H^1$(39), $H^2$(40), $PF^{50}$(41) and $PF^{69}{}_2$(42).

In FIG. 2, the vertical axis (y) represents the ion beam current, and the horizontal axis (x) represents increasing atomic mass units.

An example of a phosphorous ion beam generated utilizing the present invention in conjunction with an Eaton Corporation NV3206 ion implanter used the following parameters:

| | |
|---|---|
| Feed Gas: | HF |
| Gas Inlet Pressure: | $10^{-3}$ Torr |
| Filament Voltage: | 3.5 volts |
| Filament Current: | 60 Amp |
| Arc Voltage: | 75 volts |
| Arc Current: | 0.5 Amp |
| $Ca_3P_2$ Volume: | 8 $cm^3$ |
| Extraction Voltage: | 20,090 volts. |

These conditions produced a resulting ion beam current in the $^{31}P+$ peak, of about 500 microamps.

Thus, what has been shown is a novel method to utilize safer and much less toxic feed gases in the generation of ion beams for ion implantation devices, utilizing an auxiliary chamber containing solid reactants such as $Ca_3P_2$ to reduce the HF feed gas passing therethrough and into the arc chamber, generating a more pure elemental plasma.

I claim:

1. An ion source for producing an ion beam from a feed gas comprising:

an arc chamber having an inlet orifice and an outlet orifice;

an auxiliary chamber in fluid communication with said arc chamber;

a solid compound disposed in said auxiliary chamber, said solid compound including an element to be transformed to an ion beam;

a feed gas input line into said auxiliary chamber arranged to direct a feed gas therein, said feed gas selected from the group consisting of oxygen, fluorine, or chlorine containing gases for reaction with said solid compound therein;

a filament for generating electrons in said arc chamber, together with a power source for heating and biasing said filament; and said feed gas providing an oxidizing reaction of said solid compound in said auxiliary chamber.

2. An ion source as recited in claim 1, wherein said solid compound is selected from the group consisting of metal phosphides or metal arsenides.

3. An ion source as recited in claim 2, wherein a feed gas is driven through said solid compound.

4. An ion source as recited in claim 3, wherein said auxiliary chamber containing said solid compound is heated by an external power source.

5. An ion source as recited in claim 3, wherein said auxiliary chamber containing said solid compound is heated to a temperature of about 500° C. to about 700° C.

6. An ion source as recited in claim 5, wherein said auxiliary chamber is heated by contact with said heated arc chamber.

7. A method of generating an ion beam from an arc chamber, comprising the steps of:

attaching an auxiliary chamber to a wall of the arc chamber, with an orifice providing fluid communication therebetween;

introducing a solid compound into said auxiliary chamber;

heating said arc chamber up to a temperature of about 900° C. to about 1000° C. with an energizable electron emitting filament thereacross;

passing a feed gas selected from the group consisting of oxygen, fluorine or chlorine containing gases under pressure through said solid compound in said auxiliary chamber in an oxidizing reaction so as to form a stable solid fluoride oxide or chloride compound therein; and emitting an ion beam from an exit orifice in said heated arc chamber.

8. The method of generating an ion beam as recited in claim 7, including the step of:

selecting the solid compound from the group consisting of metal phosphides or metal arsenides.

9. The method of generating an ion beam as recited in claim 8, including the step of:

selecting the feed gas to be passed through said auxiliary chamber from the group consisting of gases containing oxygen, fluorine or chlorine.

* * * * *